US006554443B2

(12) United States Patent
Fan

(10) Patent No.: US 6,554,443 B2
(45) Date of Patent: Apr. 29, 2003

(54) PUMPKIN LIGHTING FIXTURE

(75) Inventor: Sheng Ping Fan, Taipei (TW)

(73) Assignee: T.W. Piin Hung Commodities Co., Ltd., Taipei (TW)

( * ) Notice: Subject to any disclaimer, the term of this patent is extended or adjusted under 35 U.S.C. 154(b) by 0 days.

(21) Appl. No.: 09/925,460

(22) Filed: Aug. 10, 2001

(65) Prior Publication Data

US 2003/0031009 A1 Feb. 13, 2003

(51) Int. Cl.[7] ..... F21V 33/00

(52) U.S. Cl. ..... 362/96; 362/253; 362/294; 362/806; 40/428

(58) Field of Search ..... 362/96, 234, 235, 362/278, 320, 806, 294, 373, 253; 40/540, 406, 409, 428, 439, 412, 431, 436

(56) References Cited

U.S. PATENT DOCUMENTS 1,824,388 A * 9/1931 Birch ..... 362/96
3,603,013 A * 9/1971 Reed ..... 40/428
6,312,137 B1 * 11/2001 Hsieh ..... 362/96

* cited by examiner

*Primary Examiner*—Stephen Husar
*Assistant Examiner*—Bao Truong
(74) *Attorney, Agent, or Firm*—Rosenberg, Klein & Lee

(57) ABSTRACT

A pumpkin lighting fixture, comprising a pumpkin-shaped housing, and a lighting mechanism that is installed inside the hollow of the housing: The lighting mechanism is composed of a lamp carrier, a fan and a battery box, which are jointly assembled in a round depression of a base. On the lamp carrier is a plurality of LED lamps, and a woven fabric that is cut in the shape of a flame, so that each LED projects light on the woven fabric. The fan has an air outlet that is aligned with the woven fabric, so air is blown onto the woven fabric to make it bellow. Such a lighting mechanism presents realistic and beautiful burning-flame effects, enabling safety in application of this pumpkin lighting fixture.

7 Claims, 3 Drawing Sheets

PUMPKIN LIGHTING FIXTURE

BACKGROUND OF THE INVENTION

1. Field of the Invention

This invention relates to a pumpkin lighting fixture, using a lighting mechanism to present realistic burning-flame effects inside the hollow of a pumpkin-shaped housing, providing convenience and safety in application.

2. Background of the Invention

In the conventional pumpkin lighting fixture, a real flame, such as a burning candle, is generally installed inside the hollow pumpkin to present lighting effects. However, a combustible substance that produces a real flame also involves the risk of high heat, lack of control of the flame that may result in a fire, and inability of extended burning period.

Someone has introduced the installation of a lamp inside the hollow of a pumpkin lighting fixture, replacing the combustible substance. That would reduce the aforementioned risk of a fire, meanwhile, it kills the realistic effects of a real flame, as well as the fun in a pumpkin lighting fixture.

SUMMARY OF THE INVENTION

In view of seeking possible improvement, the invention provides an improved pumpkin lighting fixture, producing realistic burning-flame effects, with due consideration of safety and amusement in application. The primary objective of the invention is to provide a pumpkin lighting fixture, using a lighting mechanism inside the pumpkin lighting fixture to produce realistic burning-flame effects, with effective control of the shape or burning time of the flame simulated by lamps, therefore, it is safe and convenient in use.

According to the present invention, the pumpkin lighting fixture comprises a pumpkin-shaped housing, and a lighting mechanism that is installed inside the housing. The lighting mechanism is composed of a lamp carrier, a fan, and a battery box, which are jointly assembled in a round depression of a base. The battery accommodated in the battery box supplies power required for the lighting performance. On the lamp carrier is a plurality of LED lamps and a woven fabric that is cut in the shape of a flame. The LED projects light on the woven fabric. The fan has an air outlet that is aligned with the woven fabric, to blow air on the fabric and make it bellow.

The lighting mechanism can achieve the anticipated objective by presenting realistic burning-flame appearance, and meanwhile providing safety in application of the pumpkin lighting fixture.

The drawings of preferred embodiments of this invention are described in following details to enable better understanding.

DETAILED DESCRIPTION OF PREFERRED EMBODIMENTS

Figure 1:
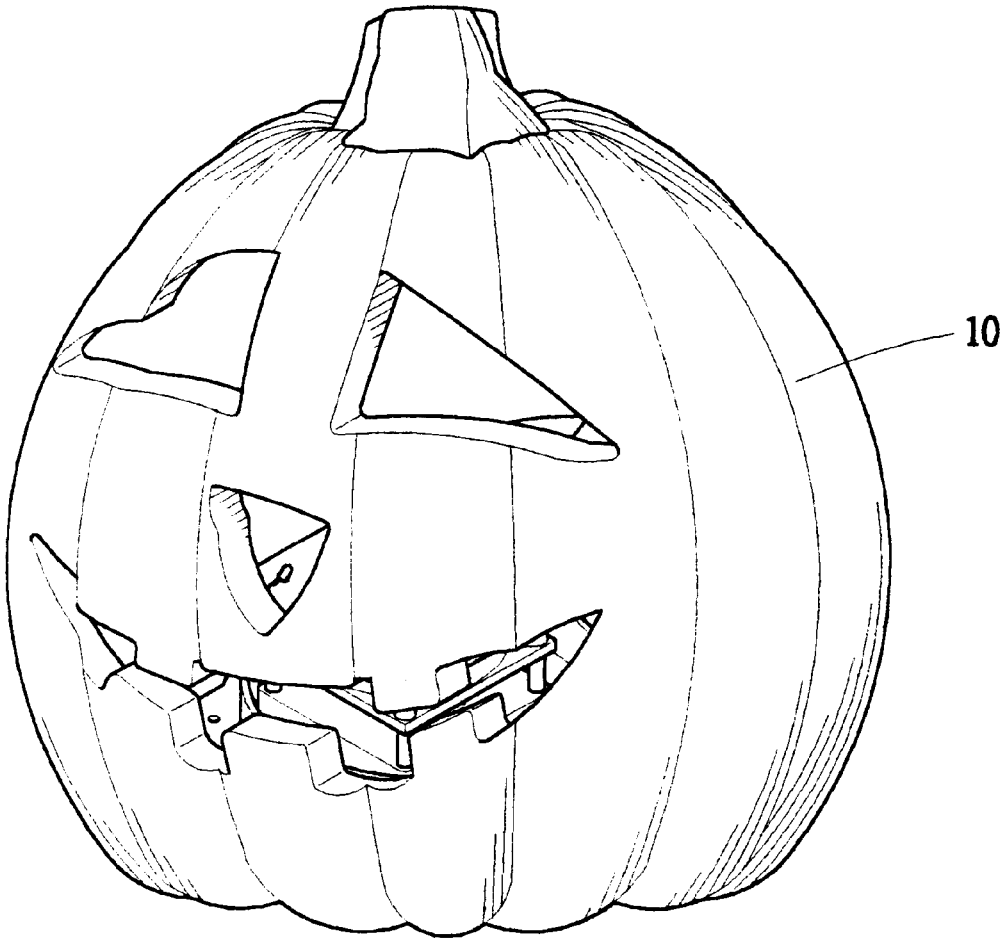
FIG. 1 is a perspective view of the invention.
Figure 2:
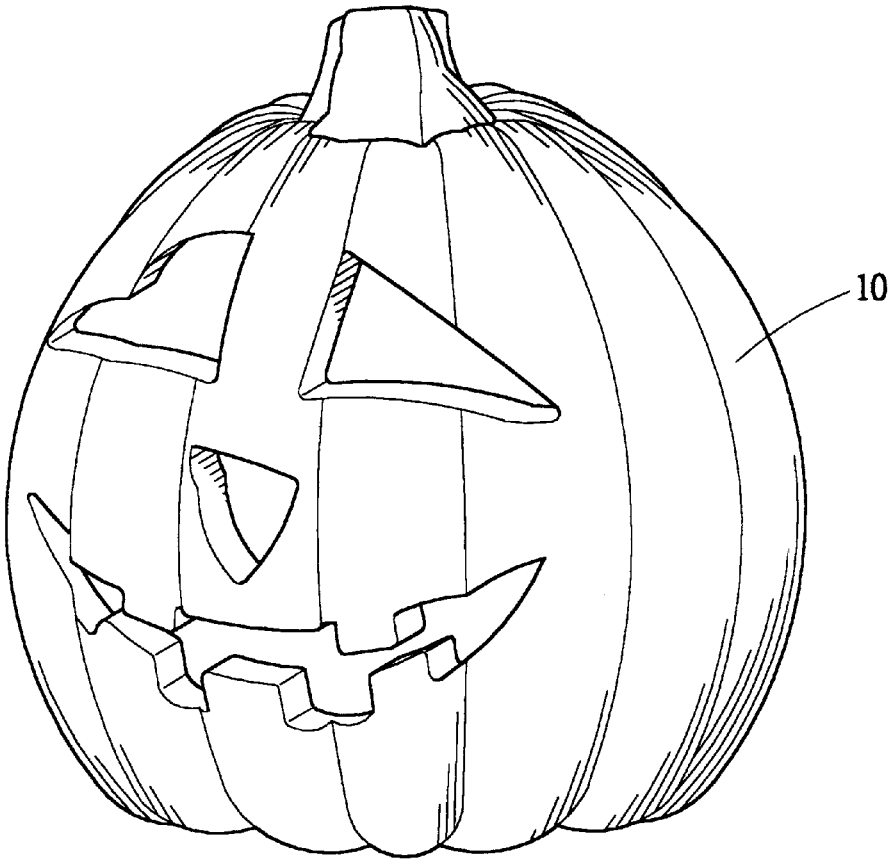
FIG. 2 is a disassembled view of the invention, showing the housing separated from the lighting mechanism.
Figure 2:
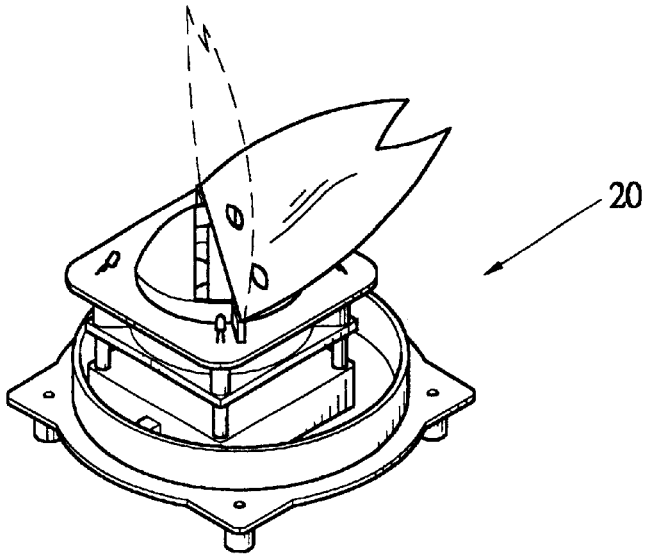

As shown in FIGS. 1 and 2, the pumpkin lighting fixture of the invention comprises a napkin-shaped housing 10, and a lighting mechanism that is installed inside the hollow of the housing 10.

The housing 10 is a hollow compartment. There are cut holes in the configuration of a facial expression on the exterior of the housing 10.

Figure 3:
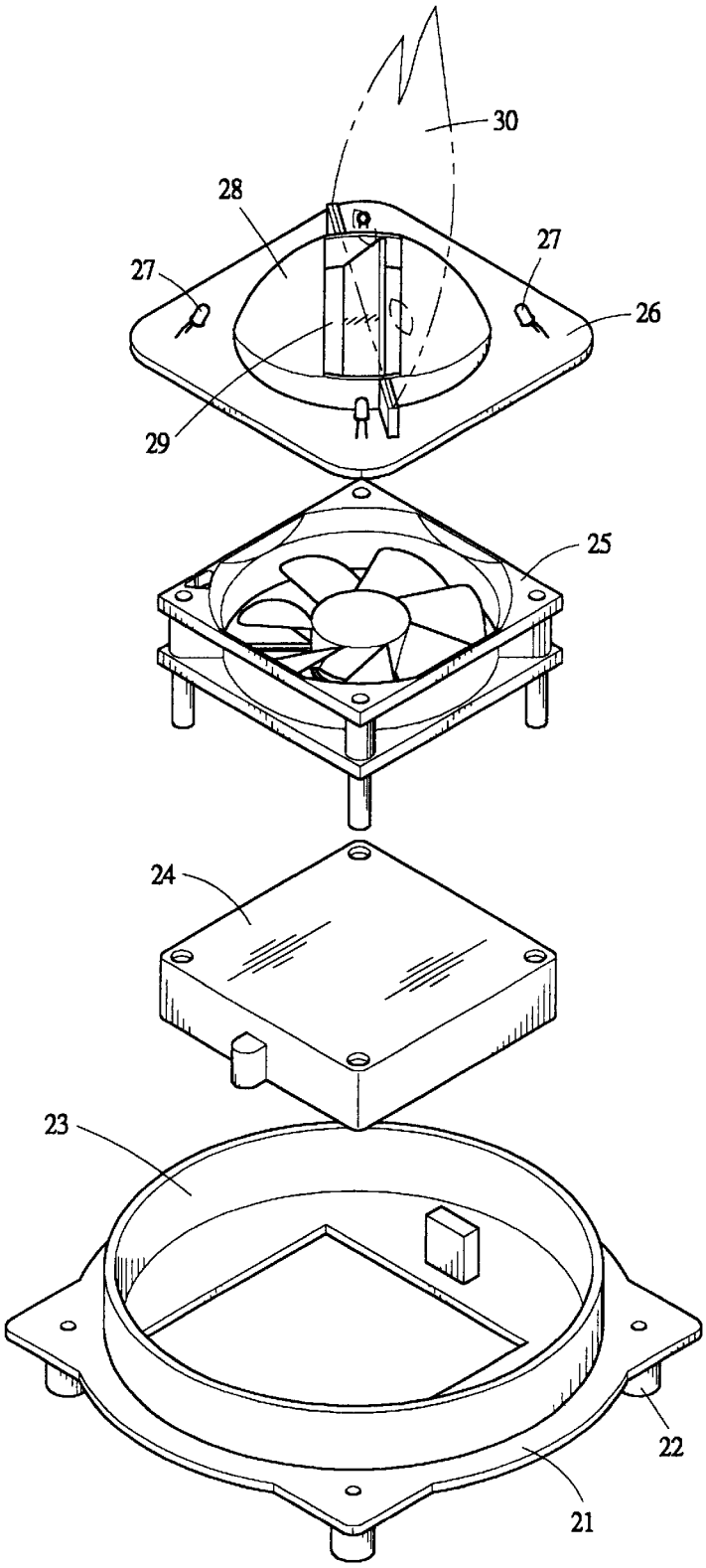
FIG. 3 is an exploded view of the invention.

As shown in FIG. 3, the lighting mechanism 20 comprises a base 21, a battery box 24, a fan 25, and a lamp carrier 26. The battery box 24, the fan 25, and the lamp carrier 26 are jointly assembled inside a round depression of the base 21. On the bottom of the base 21 There are a plurality of screw hole posts 22 arranged on the bottom of the base 21 and used to fasten the base 21 inside the hollow of the pumpkin-shaped housing 10.

As shown in FIG. 3, the battery box 24 serves to accommodate a battery. The battery accommodated inside the battery box 24 has a switch control (the battery and the switch are not shown in the drawings), supplying power to the lighting mechanism 20.

The fan 25 is located between the battery box 24 and the lamp carrier 26, providing air blown onto a woven fabric 30 (to be described later) to bellow.

The lamp carrier 26 is assembled onto the fan 25. The lamp carrier 26 has a plurality of LEDs 27 and a piece of woven fabric 30 arranged thereon. The woven fabric 30 is cut in the shape of a flame. An air duct 28 is located at the center of the lamp carrier 26. The air duct 28 has an air outlet 29 that is located at the bottom of the woven fabric 30.

Each LED 27 projects its light on different parts of the woven fabric 30. Since the direction of air blown from the fan 25 is controlled by the air duct 28, and the air duct 28 is located at the bottom of the woven fabric 30, the air will blow the woven fabric 30 to shake.

The color of the light projected by each LED 27 is preferably similar to that of a flame, such as red, yellow and blue.

The lighting mechanism 20 produces realistic flame effects. Further, the lighting mechanism 20 of the invention will not produce high heat and danger that can be found in combustible substances.

Depending on the cubic measurements of the housing 10 in the invention, the size of woven fabric 30 can be changed, the quantity of the LED can be increased or decreased, or the position of the LED can be changed to enable better and realistic effects of a burning flame.

The invention has been described in details in order that people skilled in the art can make the final product accordingly. But the aforementioned embodiment is for the purpose of explanation only. Therefore, all equivalent structural variations and similar modifications without departing from the invention shall be included in the spirit and intent of the subject claim.

What is claimed is:

1. A pumpkin lighting fixture, comprising:

a pumpkin-shaped housing having a hollow compartment therein, an exterior surface of the housing having cut holes formed therein in a facial expression configuration; and a lighting mechanism installed inside the hollow compartment of the pumpkin-shaped housing, the lighting mechanism including a base having a round depression in which are disposed a lamp carrier, a woven fabric configured in a shape of a flame disposed above the lamp carrier, a fan, and a battery box for accommodating a battery, the fan being located between the battery box and the lamp carrier, the fan serving to blow air on the woven fabric to cause the woven fabric to shake, the lamp carrier being assembled onto the fan and having a plurality of LEDs on the lamp carrier, the LEDs being electrically coupled to the battery, the lamp carrier having an air duct located at a central portion thereof and having an air outlet located at a bottom of the woven fabric, wherein light projected from the lighting mechanism inside the pumpkin-shaped housing presents realistic burning-flame effects.

2. The pumpkin lighting fixture as claimed in claim 1, wherein each of the LEDs lamp projects light on the same areas of said woven fabric.

3. The pumpkin lighting fixture as claimed in claim 1, wherein each of the LEDs lamp projects light on the different areas of said woven fabric.

4. The pumpkin lighting fixture as claimed in claim 1, wherein each of the LEDs lamp projects light in a single color similar to the flame.

5. The pumpkin lighting fixture as claimed in claim 1, wherein each of the LEDs lamp projects light in multiple colors similar to the flame.

6. The pumpkin lighting fixture as claimed in claim 1, wherein, the size of the woven fabric can be changed to suit the cubic measurements of the housing.

7. The pumpkin lighting fixture as claimed in claim 1, wherein, the quantity and position of the LED lamps can be changed depending on the cubic measurements of the housing.

* * * * *